United States Patent [19]

Kasuya

[11] Patent Number: 4,831,415

[45] Date of Patent: May 16, 1989

[54] IMAGE FORMING APPARATUS CONTROLLED IN RESPONSE TO DETECTED CHARACTERISTICS OF AN ORIGINAL

[75] Inventor: Yukio Kasuya, Inagi, Japan

[73] Assignee: Canon Kabushiki Kaisha, Tokyo, Japan

[21] Appl. No.: 175,674

[22] Filed: Mar. 25, 1988

Related U.S. Application Data

[63] Continuation of Ser. No. 877,263, Jun. 23, 1986, abandoned, which is a continuation of Ser. No. 581,901, Feb. 21, 1984, abandoned.

[30] Foreign Application Priority Data

| | | | |
|---|---|---|---|
| Feb. 25, 1983 | [JP] | Japan | 58-29404 |
| Feb. 25, 1983 | [JP] | Japan | 58-29405 |
| Feb. 26, 1983 | [JP] | Japan | 58-30216 |
| Feb. 28, 1983 | [JP] | Japan | 58-30904 |
| Feb. 28, 1983 | [JP] | Japan | 58-30905 |
| Feb. 28, 1983 | [JP] | Japan | 58-30906 |
| Feb. 28, 1983 | [JP] | Japan | 58-30907 |

[51] Int. Cl.[4] ..... G03G 15/00

[52] U.S. Cl. ..... 355/208; 355/214

[58] Field of Search ..... 355/14 R, 14 D, 14 E, 355/68, 69

[56] References Cited

U.S. PATENT DOCUMENTS

| | | | |
|---|---|---|---|
| 2,956,487 | 10/1960 | Giaimo, Jr. | 355/140 |
| 3,728,023 | 4/1973 | Stevko et al. | 355/68 X |
| 3,864,035 | 2/1975 | Kuehnle | 355/14 R |
| 3,877,413 | 4/1975 | Rowell et al. | 355/14 D X |
| 4,136,945 | 1/1979 | Stephens | 355/69 X |
| 4,153,364 | 5/1979 | Suzuki et al. | 355/14 E |
| 4,222,660 | 9/1980 | Furuichi et al. | 355/14 R |
| 4,239,374 | 12/1980 | Tatsumi et al. | 355/14 E |
| 4,306,804 | 12/1981 | Sakamoto et al. | 355/14 E |
| 4,477,178 | 10/1984 | Furuichi et al. | 355/14 R |
| 4,529,291 | 7/1985 | Mizogui | 354/289.1 X |
| 4,564,287 | 1/1986 | Suzuki et al. | 355/14 D |
| 4,583,839 | 4/1986 | Suzuki | 355/14 R |
| 4,603,245 | 7/1986 | Yagasaki | 219/216 |
| 4,674,863 | 6/1987 | Tomosada et al. | 355/14 E |

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

Image forming apparatus equipped with two detecting devices. The first device is used for determining the image forming condition prior to the image formation, and this condition is corrected during the image formation according to the state of the original document detected by the second detecting device.

17 Claims, 19 Drawing Sheets

| VAC TABLE | |
|---|---|
| DVAE | VAC(V) |
| 0 | 80 |
| 1 | 82 |
| 2 | 84 |
| 3 | 86 |
| 4 | 88 |
| 5 | 90 |
| 6 | 92 |
| 7 | 94 |
| 8 | 96 |
| 9 | 98 |
| A | 100 |
| B | 102 |
| C | 104 |
| D | 106 |
| E | 108 |
| F | 110 |

LIGHT

ORIGINAL DENSITY

DARK

IMAGE FORMING APPARATUS CONTROLLED IN RESPONSE TO DETECTED CHARACTERISTICS OF AN ORIGINAL

This application is a continuation of application Ser. No. 877,263, abandoned, filed June 23, 1986, which in turn is a continuation of Ser. No. 581,901, filed Feb. 21, 1984, abandoned.

BACKGROUND OF THE INVENTION

1. Field of the Invention

The present invention relates to an image forming apparatus such as a copier, and more particularly to an image forming apparatus equipped with imaged density control means for determining an appropriate image forming condition at the image formation according to the measurement of the density of the original document.

2. Description of the Prior Art

Conventionally there are known following two methods for controlling the image density in this manner:

(1) a method of measuring and storing the original density, and suitably regulating image forming conditions such as the intensity of the exposure lamp or the developing bias according to thus stored original density at the image formation; and (2) a method of successive comparison in which the image forming conditions are feedback controlled according to the original density read during the image formation.

In the method (1) in which a pre-scanning for measuring the original density is conducted prior to the image formation, the continuous copying operation is conducted, regardless of the number of copies desired, according to an automatic exposure (AE) value corresponding to the original image density determined by the pre-scanning. However in case an elevated number of copies are formed in a continuous copying operation, the image forming conditions often vary between the start and the end of the continuous copying operation. Consequently the image density on the obtained copies may vary even if the AE value is maintained constant.

Also said pre-scanning should preferably be conducted over the entire area of the original, it is often conducted only over a part of the original in order to avoid loss in the copying speed. An exact measurement of the original density cannot be expected in such case if the original contains for example a solid black area in such measured part.

On the other hand, in the latter method in which is the original image density is measured in succession simultaneously with the image formation, a precise feedback control according to the original image density becomes difficult due to a delay in the feedback for example in case the original contains black and white areas in repetition.

Also in the conventional methods, the measurement of the AE value and the determination of the control values for operable conditions such as the light intensity of the exposure lamp, and the potential of the developing bias etc. have to rely on a time-consuming logic processing according to a determined formula.

SUMMARY OF THE INVENTION

In consideration of the foregoing, an object of the present invention is to provide an image forming apparatus capable of image formation constantly with an optimum image density.

Another object of the present invention is to provide an image forming apparatus constantly capable of optimum image formation regardless of the number of time of image formation by correcting image forming conditions determined in advance according to the original image.

Still another object of the present invention is to provide an image forming apparatus capable of detecting the status of the original at a regular time interval or at every determined number of copying cycles.

Still another object of the present invention is to provide an image forming apparatus equipped with memory means for storing in advance control $ values for image forming means corresponding to the state of the original, and capable of appropriate image formation through a simple control by detecting the state of the original and reading said control values from said memory means according to the result of said detection to control the image forming means.

In accordance with the invention a detector is provided for detecting the portion of a latent image of an original formed on a photosensitive member prior to the exposure of an original image for use in image formation. A second detector detects the original image light during the exposure used for image formation, and control means are provided for controlling the apparatus in plural modes in accordance with the output of the two detectors.

BRIEF DESCRIPTION OF THE DRAWINGS

FIGS. 2-1 and 2-2 are timing charts of a pre-scanning;

FIGS. 9-1 and 9-2 are flow charts showing an operation of conducting the pre-scanning at every determined number of copies;

DESCRIPTION OF THE PREFERRED EMBODIMENTS

Now the present invention will be clarified in detail by embodiments thereof shown in the attached drawings.

Figure 1:
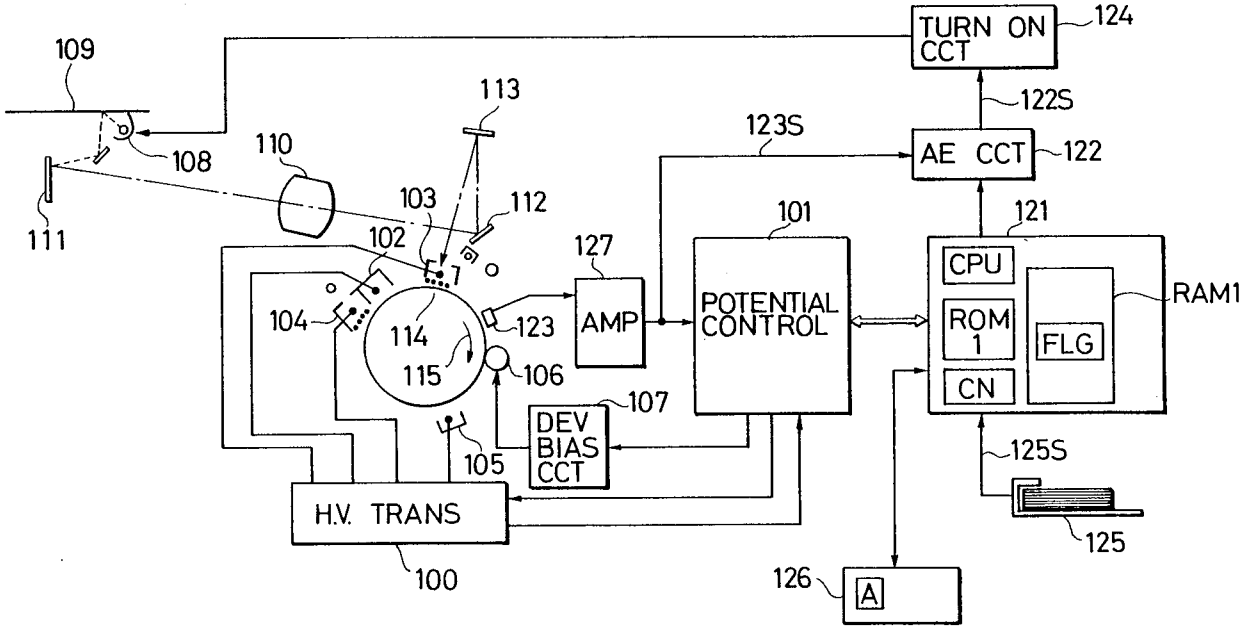
FIG. 1 is a schematic view of a copier embodying the present invention.

FIG. 1 shows an embodiment of the present invention, wherein a high-voltage transformer 100 controls, according to control signals supplied from a potential control circuit 101, the function of a primary charger 102, a secondary charger 103, a pre-charger 104 and a transfer charger 105. A developing bias cylinder 106 is controlled by a developing bias circuit 107. An original illuminating lamp 108 illuminates an original document 109, and the reflected light is transmitted through a lens 110 and mirrors 112, 113 and focused on a photosensitive drum 114. Said drum 114 is rotated in a direction of arrow 115 in synchronization with the exposure to said reflected light to form an electrostatic latent image of the original on said photosensitive drum.

Figure 5:
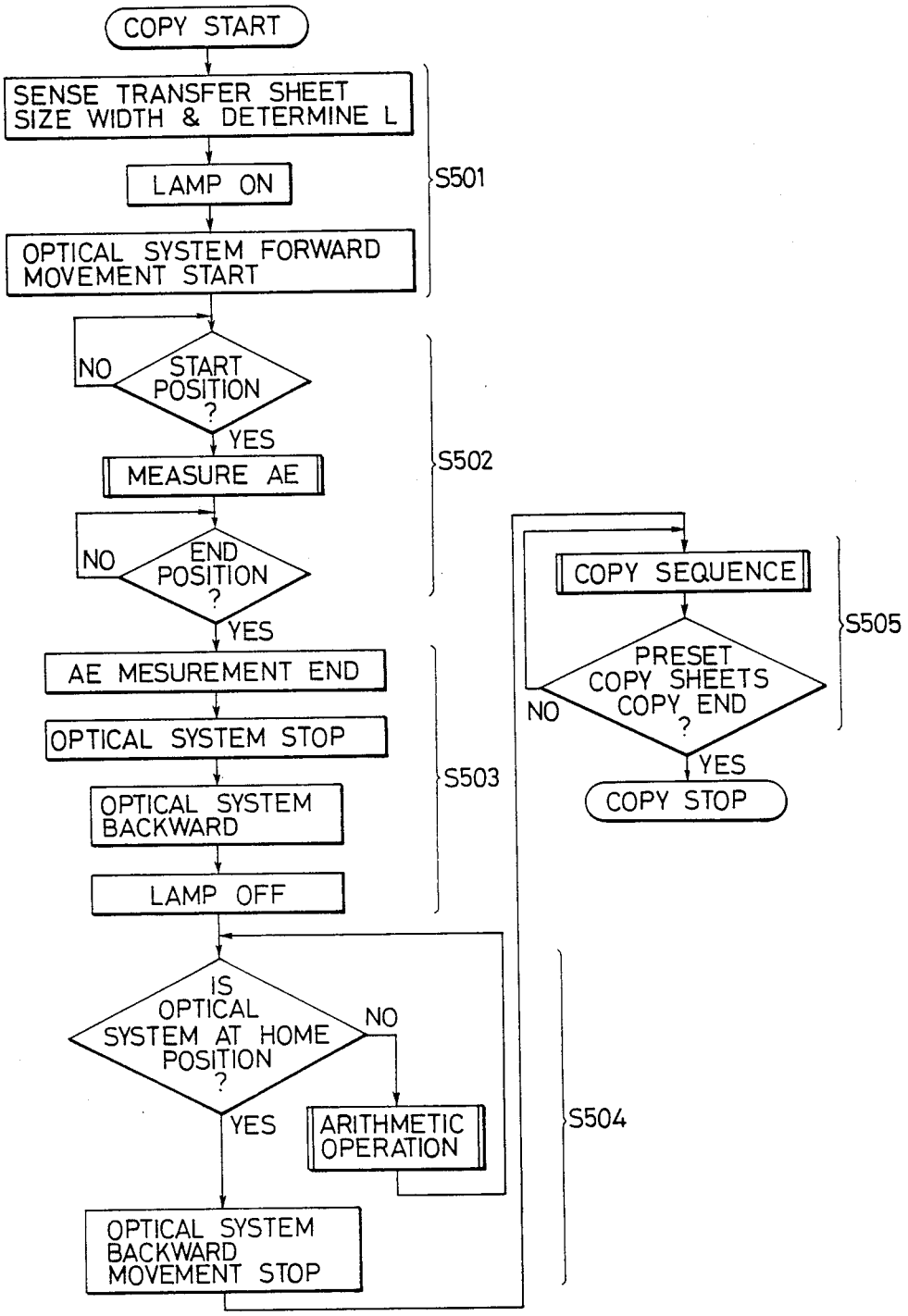
FIGS. 5, 6 and 8 are flow charts showing the function of the copier shown in FIG. 1.
Figure 8:
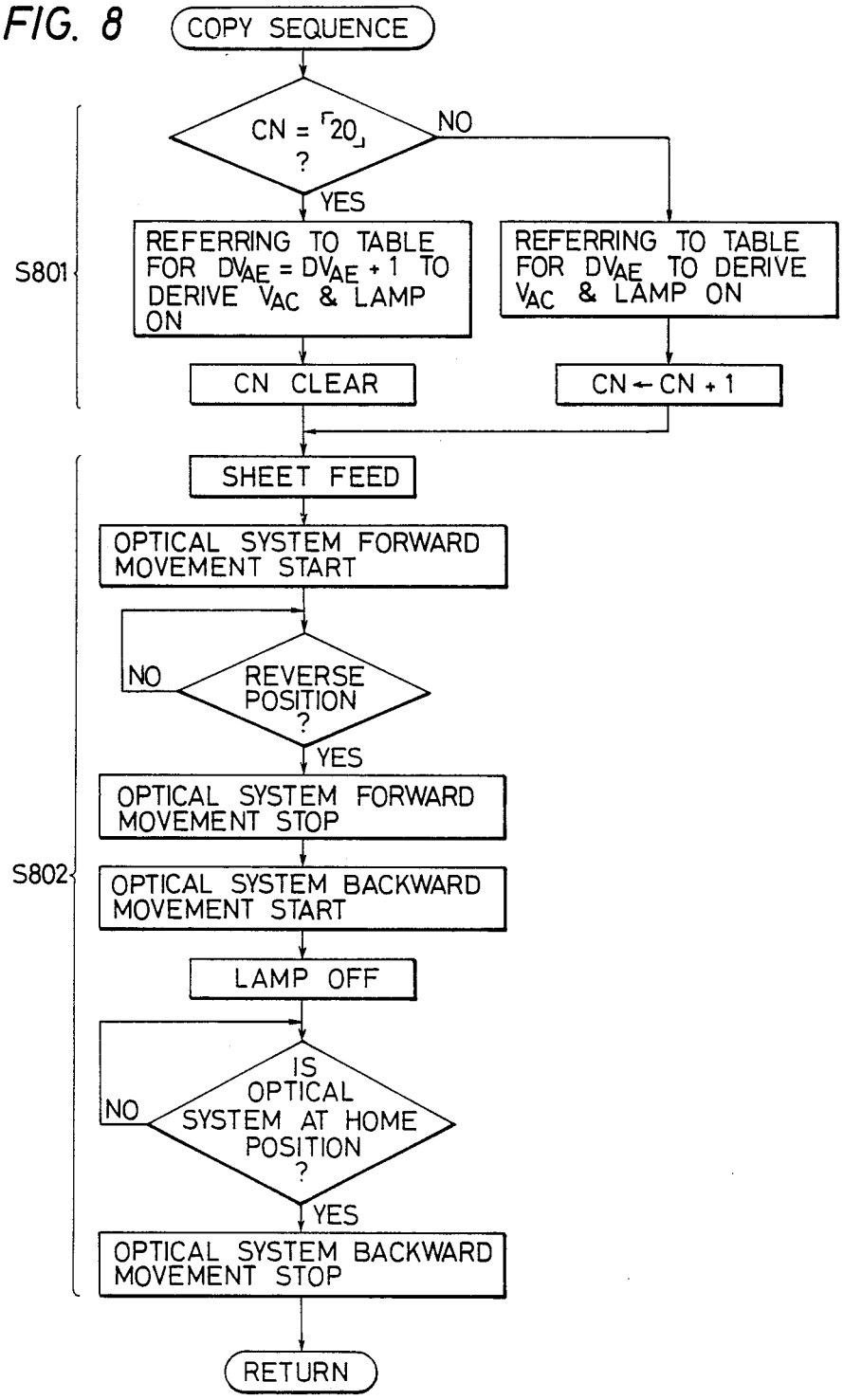

A control circuit 121 for controlling various loads is composed of a microcomputer including a central processing unit CPU, a memory ROM1 storing control programs shown in FIGS. 5 and 8, a random access memory RAM1 for temporarily storing various data such as the copy number etc. Said control circuit is provided with a copy number counter CN for counting the number of copies.

The control circuit 121 supplies control signals to the potential control circuit 101 and an image exposure or automatic exposure (AE) circuit 122. A detector 123 senses a condition corresponding to a characteristic of the original. Specifically, the potential sensor 123 for measuring the surface potential of the photosensitive drum releases an output signal 123S representing the surface potential, which is supplied, after amplification in an amplifier 127, to said potential control circuit 101 and AE circuit 122. Said AE circuit 122 calculates the original density from said output signal 123S and supplies a corresponding control signal 122S to a turn-on circuit 124, which turns on the illuminating lamp 108 with a lighting voltage determined in response to said signal 122S. A container 125, containing recording sheets, supplies, to the control circuit 121, a signal 125S indicating the size of the contained recording sheets. An operation unit 126 is provided on the main body of the copier and is provided with various keys for use by the operator to set the number of copies, and to enter a manual instruction for a start command for starting the copying operation etc.

Figures 1, 2:
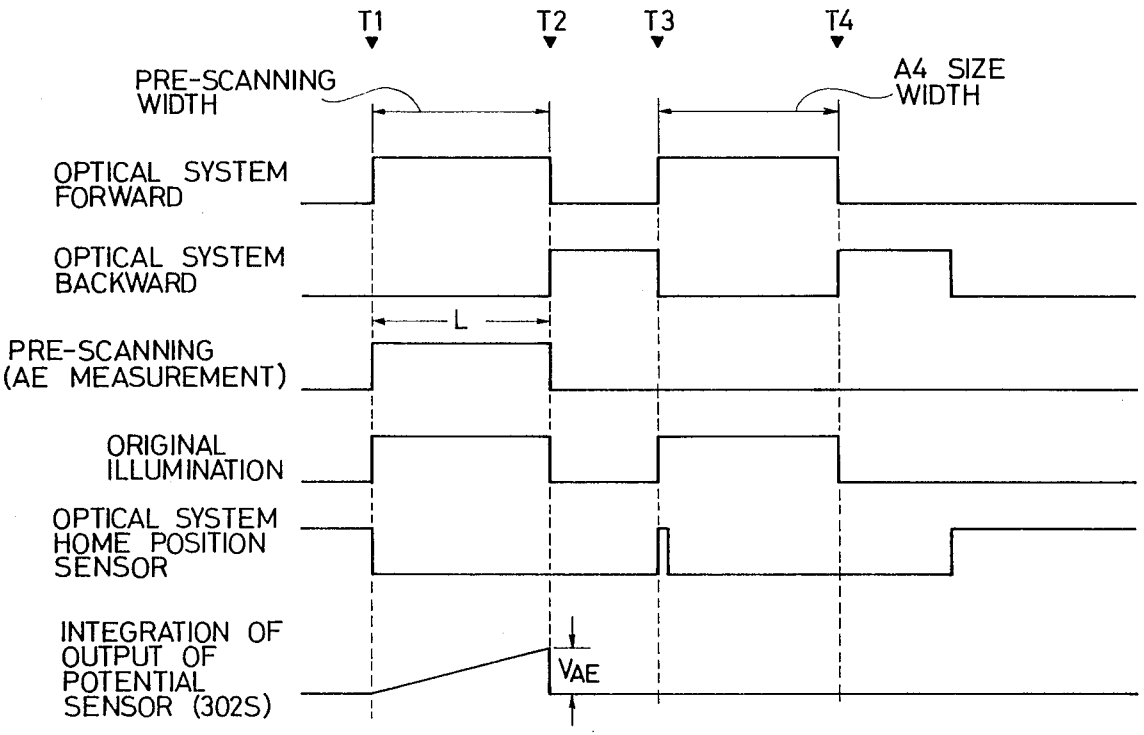
Figure 2:
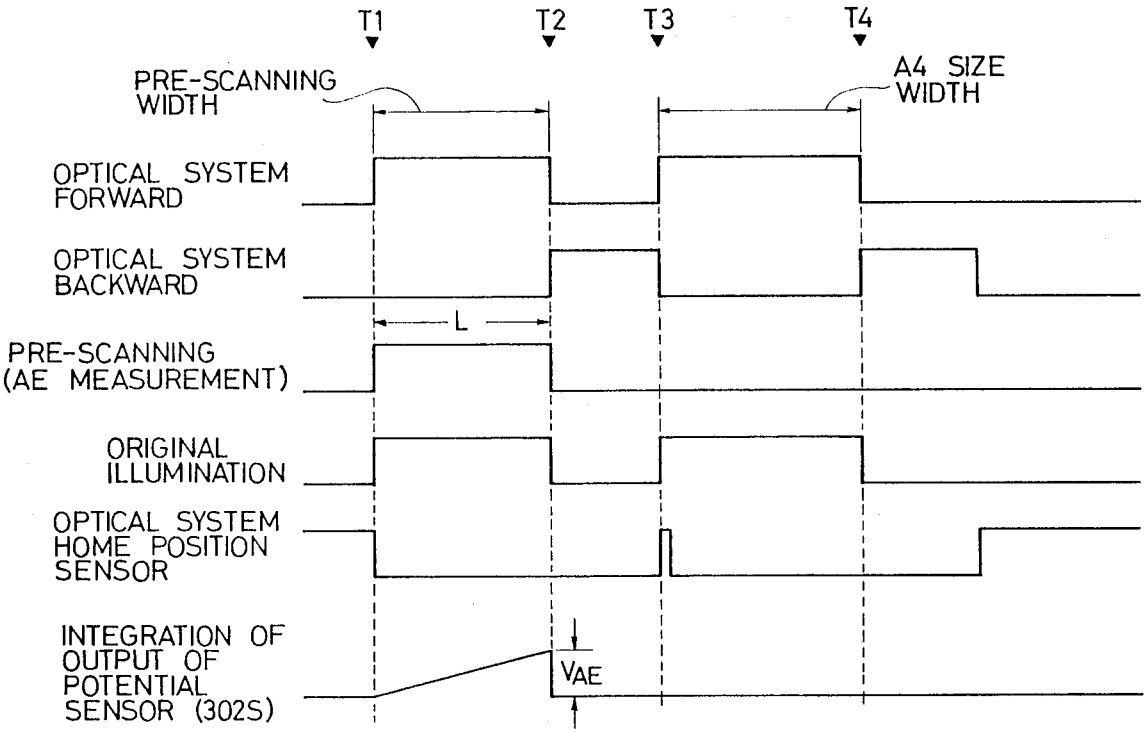

FIG. 2-1 is a timing chart indicating the function of the present embodiment in case of copying an A4-sized original, wherein L represents a pre-scanning width (automatic exposure measuring width). The AE circuit 122 read the output signal 123S from the potential sensor 123 over a period corresponding to said pre-scanning width L. Said pre-scanning width is selected, as will be explained later, equal to the width of the recording sheet employed for image formation, namely A4 size in the present embodiment. The size of the recording sheet is usually equal to that of the original to be read, so that the pre-scanning is conducted over the entire area of the original if the pre-scanning width L is selected equal to the size of the recording sheet employed for image formation.

Said pre-scanning can however be conducted not over the entire area but over a part thereof. As an example, the pre-scanning width may be selected smaller than the width of a smallest usable recording sheet, for example the recording sheet of B5 size. FIG. 2-2 shows a timing chart in such case.

It is furthermore possible to conduct said pre-scanning over the entire area if the original does not exceed a determined size, for example A4 size, and to conduct the pre-scanning over a determined area for example of A4 size if the original exceeds said determined size.

Figure 3:
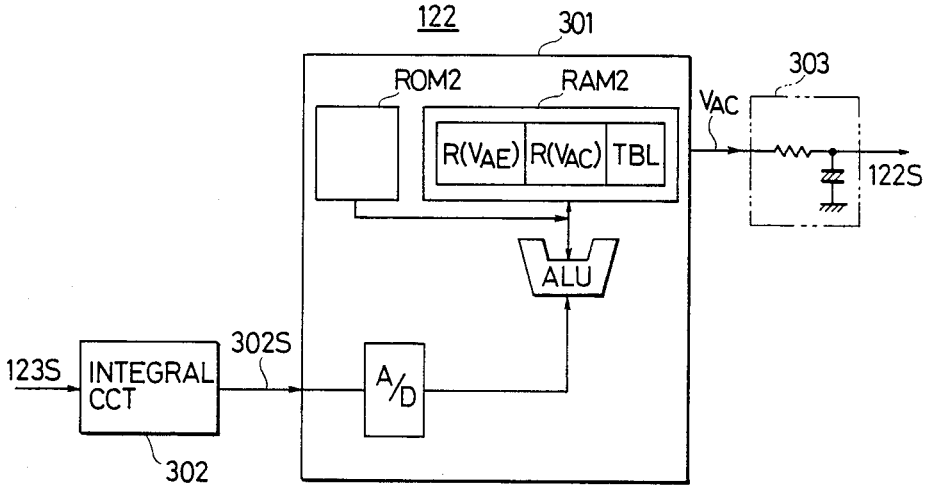
FIG. 3 is a circuit diagram of a control circuit.
Figure 4:
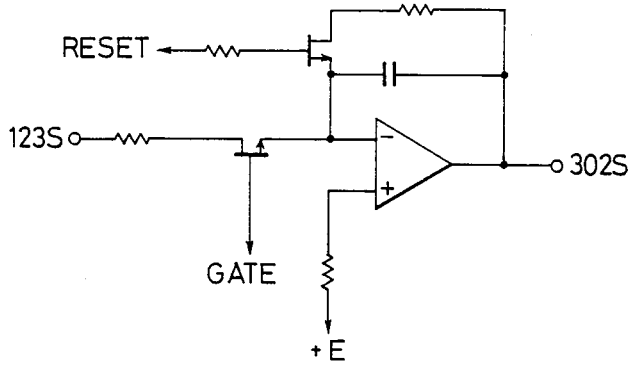
FIG. 4 is a circuit diagram of an exposure control circuit.
Figures 6, 7:
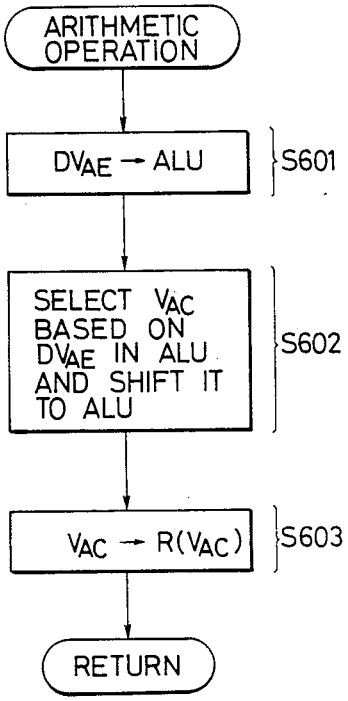
FIG. 7 is a logic table.

FIG. 3 shows an example of the AE circuit 122, wherein a one-chip microcomputer 301 is provided with a memory ROM2 storing programs shown in FIG. 6, an accumulator ALU, a memory RAM2 for temporarily storing data, and an analog-to-digital converter A/D. The memory RAM2 contains areas of a data table ($V_{AC}$ table) TBL shown in FIG. 7 and registers $R(V_{AE})$ and $R(V_{AC})$. An integral circuit 302 integrates the output signal 123S of the potential sensor over a period corresponding to the pre-scanning width L. FIG. 4 shows an example of said integrating circuit 302, of which output signal 302S is supplied to the microcomputer 301.

A digital-to-analog converter 303 converts a digital signal $V_{AC}$ supplied from the microcomputer 301 into an analog signal 122S for supply to the turn-on circuit 124.

The AE circuit of the above-described structure determines the lighting voltage of the illuminating lamp 108 in response to the output signal 123S representing the surface potential of the photosensitive drum, in the manner to be explained later.

Now reference is made to FIGS. 5, 6 and 8 for explaining the function of the above-described embodiment.

When the copying operation is started after the copying conditions such as the copy number N and the sheet size are determined, a step S501 in FIG. 5 determines the pre-scanning width L according to the size of the recording sheet. More specifically the control circuit 121 detects the size of the recording sheet from the signal 125S from the container 125, and the width of said size is selected as the pre-scanning width L, whereby the reversing position of the optical system is accordingly determined. Thereafter the optical system initiates forward motion, thereby starting the prescanning for determining the exposure of the original (time T1 in FIG. 2-1). A step S502 measures the original image density over the width L of the size of recording sheet (period T1–T2 in FIG. 2-1). More specifically the AE circuit 122 receives the output signal 123S of the potential sensor over a period corresponding to said width L, and stores a digitally converted value $DV_{AE}$ of thus obtained integrated value $V_{AE}$ into the memory RAM2. A step S503 returns the optical system, which has completed the measurement of the original image density, to a home position (period T2–T3 in FIG. 2-1). A step S504 effects processing, during said returning operation, for determining the lighting voltage of the illuminating lamp 108 according to the integrated value $DV_{AE}$ as will be more detailedly explained later. After the completion of the reversing motion of the optical system, a step S505 starts a copying sequence to be explained later for obtaining a copy. The copying operation is terminated after copies of the predetermined number N are obtained.

FIG. 6 shows a process routine, corresponding to the step S504 in FIG. 5, to be executed by the AE circuit 122. A step S601 transfers the integrated value $DV_{AE}$ obtained by the pre-scanning to the accumulator ALU, and a step S602 refers to the table TBL in the memory RAM in response to said value $DV_{AE}$.

FIG. 7 shows an example of said table TBL. As an example, if $DV_{AE}=2$ indicating that the pre-scanned original has a low density, the table TBL provides a voltage $V_{AC}=84$ (V) corresponding to $DV_{AE}=2$.

A step S603 stores thus selected voltage $V_{AC}$ into the register $R(V_{AC})$ in the memory RAM. The lighting voltage $V_{AC}$ of the illuminating lamp 108 is determined from the measured value $V_{AE}$. The value $DV_{AE}$ is selected smaller for a low image density of the original, and vice versa.

After the determination of the lighting voltage in this manner, the copying sequence (step S505 in FIG. 5) is executed in the aforementioned manner.

FIG. 8 shows said copying sequence, wherein a step S801 discriminates whether the number of completed copies counted by the counter CN has reached the number $N_0$, which is equal to 20 in the present example. If negative, the program proceeds along a flow NO to turn on the illuminating lamp 108 (time T3 in FIG. 2-1). In this state the amount of exposure is determined by the lighting voltage $V_{AC}$ determined in the aforementioned manner. More specifically thus determined value $V_{AC}$ is supplied, after conversion into an analog signal 122S in the D/A converting circuit 302, to the turn-on circuit 124 as shown in FIG. 3, which turns on the illuminating lamp 108 according to said signal 122S. Then the content of the counter CN is increased by one, and the program proceeds to a step S802 for feeding the recording sheet and advancing the optical system. When the optical system reaches the reversing position, the forward motion is terminated and the optical system starting backward motion (time T4 in FIG. 2) to the home position. The copying sequence is completed in this manner.

On the other hand, if the step S801 identifies that the content of the counter CN has reached $N_0=20$, the program proceeds along a flow YES to refer to the table TBL, thus determining the value $V_{AC}$ corresponding to a value $(DV_{AE}+1)$ obtained by adding one to the initially measured value $DV_{AE}$. Thus, for an initially measured value $DV_{AE}=2$, the table TBL provides a value $V_{AC}=86$ (V) corresponding to $(DV_{AE}+1)=3$. In this manner the lighting voltage of the illuminating lamp 108 is increased at every 20 copies. Consequently, even in a continuous copying operation for a large number of copies, the lighting voltage can be modified to compensate a change in the image forming conditions between the beginning and end of said operation, thereby ensuring copying constantly with an appropriate density.

After the lighting voltage is corrected in this manner, the lamp 108 is turned on with thus corrected lighting voltage. Thereafter the counter CN is cleared, and the program proceeds to a step S802.

As explained in the foregoing, the reference value DV to the table is increased by one at every 20 copies in the present embodiment, changes in the image forming conditions, for example of the photosensitive drum, can be sufficiently corrected to obtain appropriately reproduced images.

In the present embodiment the change of the table reference value $DV_{AE}$ is increased by "1" at every 20 copies, but the present invention is not limited to such embodiment. The change of the table reference value $DV_{AE}$, or of the lighting voltage, should preferably be determined so as to satisfactorily cover the change in the image forming conditions.

In this manner reproduced images of appropriate density can be constantly obtained by correcting the change of the image forming conditions, through a change, at every determined number of copies, of the exposure which has been determined by pre-scanning of the original.

There may be provided an indicator for indicating the original image density obtained by the pre-scanning.

Also the pre-scanning may be repeated at a determined interval.

Figures 1, 9:
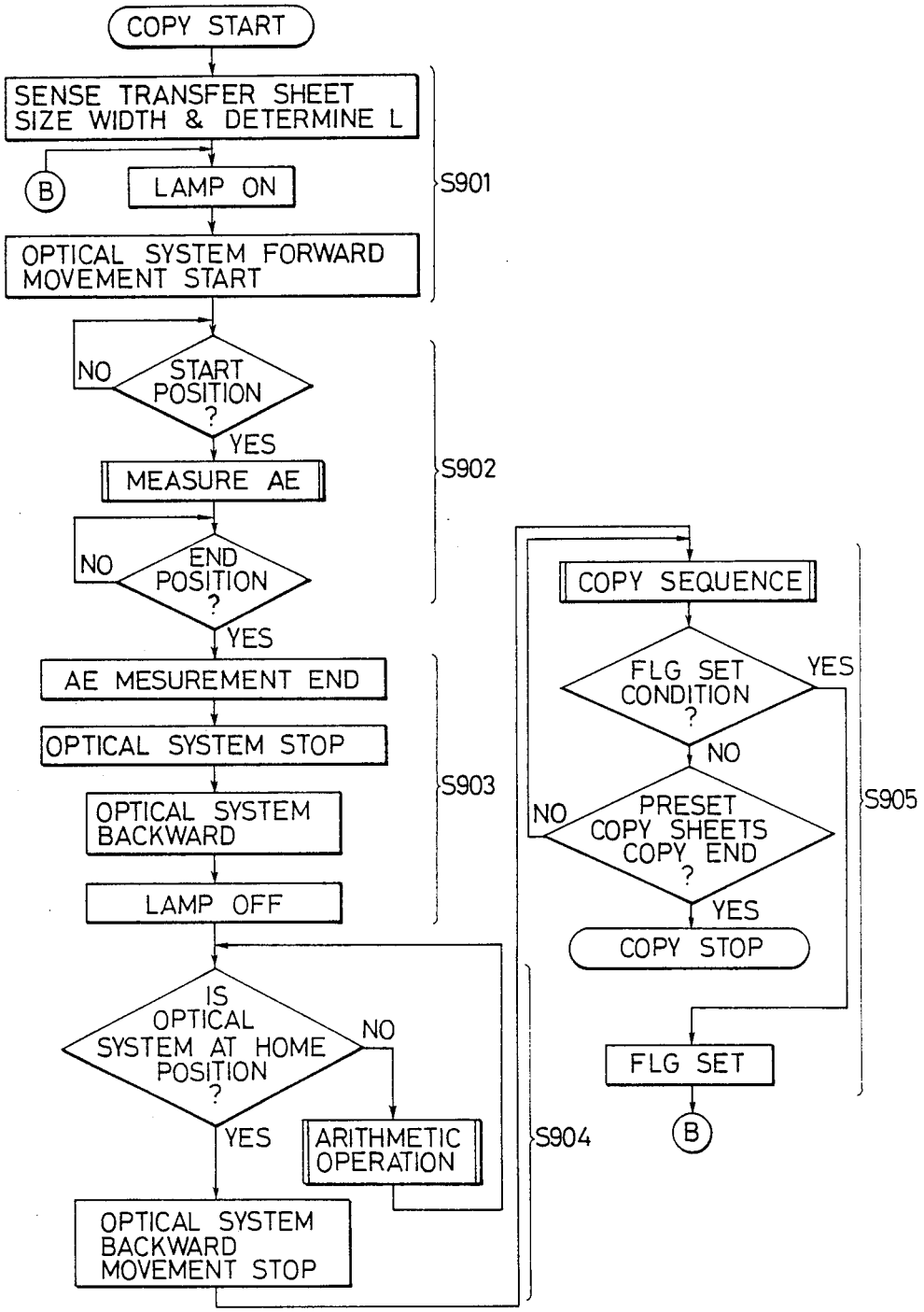
Figures 2, 9:
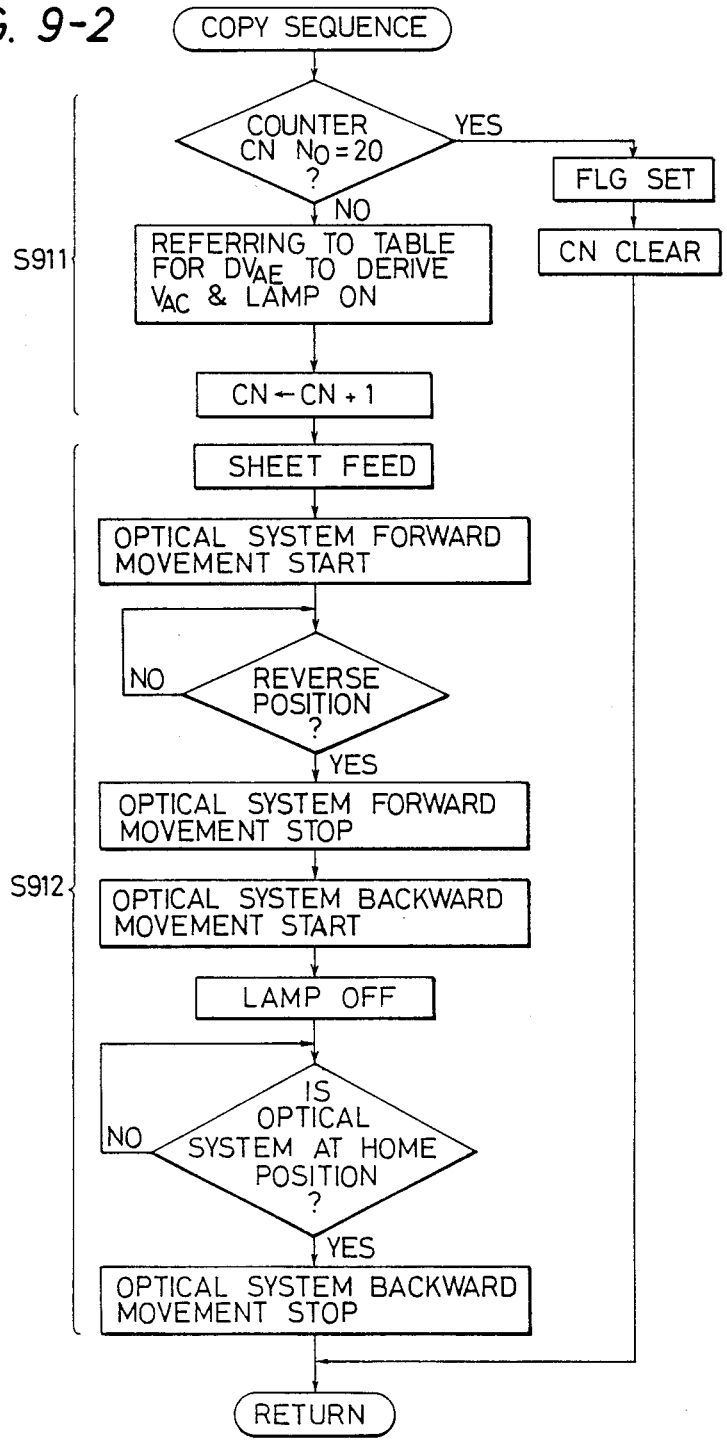

It is furthermore possible to control the lighting voltage of the illuminating lamp by conducting the pre-scanning after a determined number of copies. FIGS. 9-1 and 9-2 show corresponding control sequences.

In FIG. 9-1, steps S901–S904 are similar to the steps S501–S504 shown in FIG. 5. After tee completion of the backward motion of the optical system, a step S905 starts a copying sequence for a copy to be explained later. After the completion of said copying sequence, there is discriminated whether a re-measurement flag FLG has been set, and, if set, the program returns to the step S901 to measure the original density by the pre-scanning operation. On the other hand, if said flag FLG is reset, there is discriminated whether the copyings of set number N have been completed, and the copying operation is terminated when N copies are obtained.

Now reference is made to FIG. 9-2 for explaining the copy sequence in the step S905. The function is same as in the flow shown in FIG. 8 until the content of the counter CN reaches "20".

When a step S911 discriminates that the content $N_0$ of the counter CN reaches "20", the program proceeds along a flow YES whereby the remeasurement flag FLG is set and the counter CN is cleared. Thus the original image density is measured again in the aforementioned manner (Step S902 in FIG. 9-1), and the copying operation thereafter is conducted with a density determined according to the result of said re-measurement.

Figure 10:
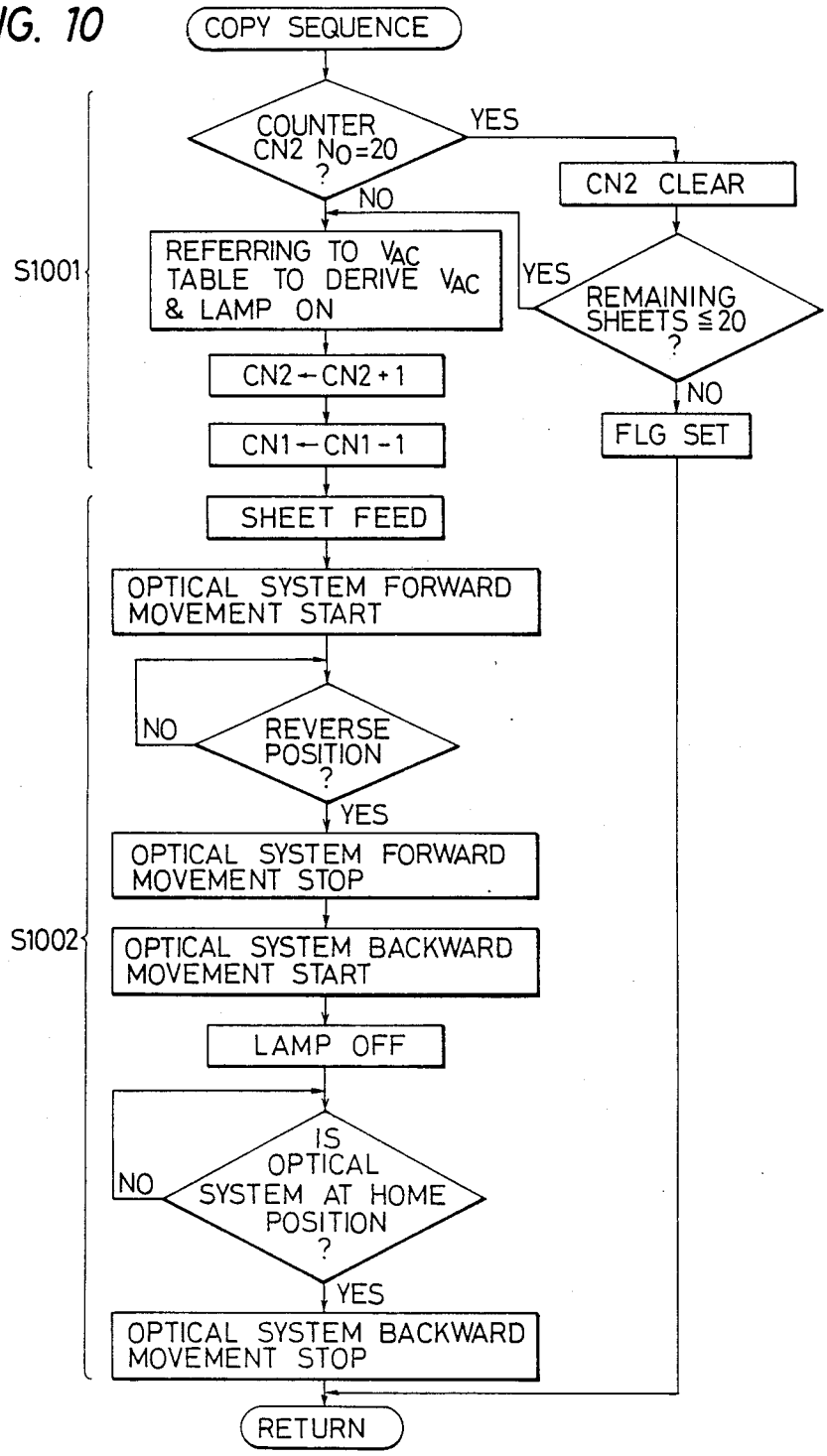
FIG. 10 is a flow chart showing an operation in which the pre-scanning is conducted at every determined number of copies but is excluded when the remaining number of copies is less than a determined number.

In such method of repeating the original density measurement at every determined number of copies, it is also possible to dispense with such re-measurement in case the remaining number of copies is less than a determined number. FIG. 10 shows a copy sequence in such case.

In FIG. 10, a step S1001 discriminates whether the number of completed copies has reached the number $N_0$ at which the pre-scanning is repeated, i.e. whether the content of tee counter CN2 has reached "20". If not, the program proceeds along a flow NO to turn on the illuminating lamp 108 (time T3 in FIG. 2). In this case the exposure is determined by the lighting voltage $V_{AC}$ to be determined in the aforementioned manner. More specifically, the determined value $V_{AC}$ is supplied, after conversion into analog signal 122S in the D/A converter 302 as shown in FIG. 3, to the turn-on circuit 124, which turns on the illuminating lamp 108 in response to said signal 122S. Thereafter the contents of the counters CN2 and CN1 are respectively increased and decreased by "1", and the program proceeds to a step 1002 for starting the sheet feeding and the forward motion of the optical system. Said forward motion is terminated at the reversing position and the optical system starts backward motion (time T4 in FIG. 2) to the home position, thus completing the copying sequence.

On the other hand, in case the step S1001 identifies that the number of completed copies has reached $N_0=20$, the program proceeds along a flow YES to clear the counter CN2. Then a discrimination is made on the content of the counter CN1 whether the remaining number of copies is less than $N_0$ (=20). If the remaining number of copies is less than 20, the program proceeds along a flow YES, through the aforementioned step S1001, to the step S1002. On the other hand, if the remaining number is equal to or more than 20, the re-measurement flag FLG is set, whereby the original image density is measured again (step S902 in FIG. 9-1). The copying thereafter is thus conducted with a density determined according to the result of said re-measurement.

In this manner image formation with a constantly appropriate image density is ensured by the repeated measurements of the original image density by pre-scannings at every determined number of copies. Also such pre-scanning may be dispensed with when the remaining number of copies is less than a determined number, thus minimizing the loss in the copying speed resulting from such repeated measurements. More specifically, in case of making 41 copies in the above-described embodiment in which the measurement is repeated at an interval of 20 copies, the 2nd measurement after the preparation of 40 copies may be dispensed with.

As shown in FIG. 1, there is further provided a mode selecting switch 126 for selecting either an automatic exposure (AE) mode or a non-AE mode. When the AE mode is selected by said switch, or no mode is selected by the operator, an original exposure circuit 122 supplies, under the control of the control circuit 121, a control signal 122S determined in response to the output signal 123S of the potential sensor to the turn-on circuit 124. On the other hand, upon selection of the non-AE mode, a control signal 122S corresponding to a density selected by the operator is supplied to the turn-on circuit 124.

In said AE mode the image forming condition, for example the exposure, is determined according to the result of detection of the original image to be copied, whereas in the non-AE mode the image forming conditions are determined in advance for example manually.

Figure 11:
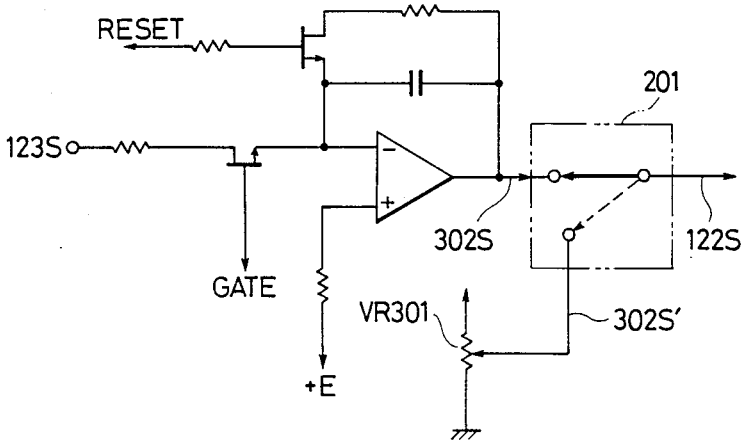

FIG. 11 shows the structure of the original exposure circuit 122, wherein a switching circuit 201 is normally in the full-lined position. In said position, the output signal 123S of the potential sensor is integrated, over the determined prescanning width, by an integrating circuit composed of an operational amplifier, and the integrated value $V_{AE}$ is supplied as the control signal 122S to the turn-on circuit 124. The function is same when the AE mode is selected by the operator.

On the other hand, when the non-AE mode is selected, the switching circuit 201 is shifted to a broken-lined position under the control of the control circuit 121, whereby a signal 302S corresponding to an original density selected by the operator is supplied as the control signal 122S to the turn-on circuit 124.

Figure 12:
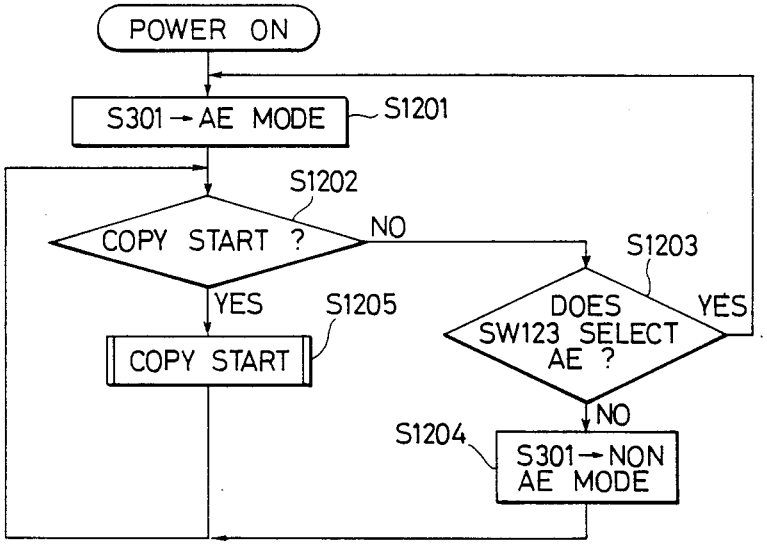
FIGS. 12 to 14 are flow charts showing an operation in which the automatic exposure mode is selected as preferential mode.
Figure 13:
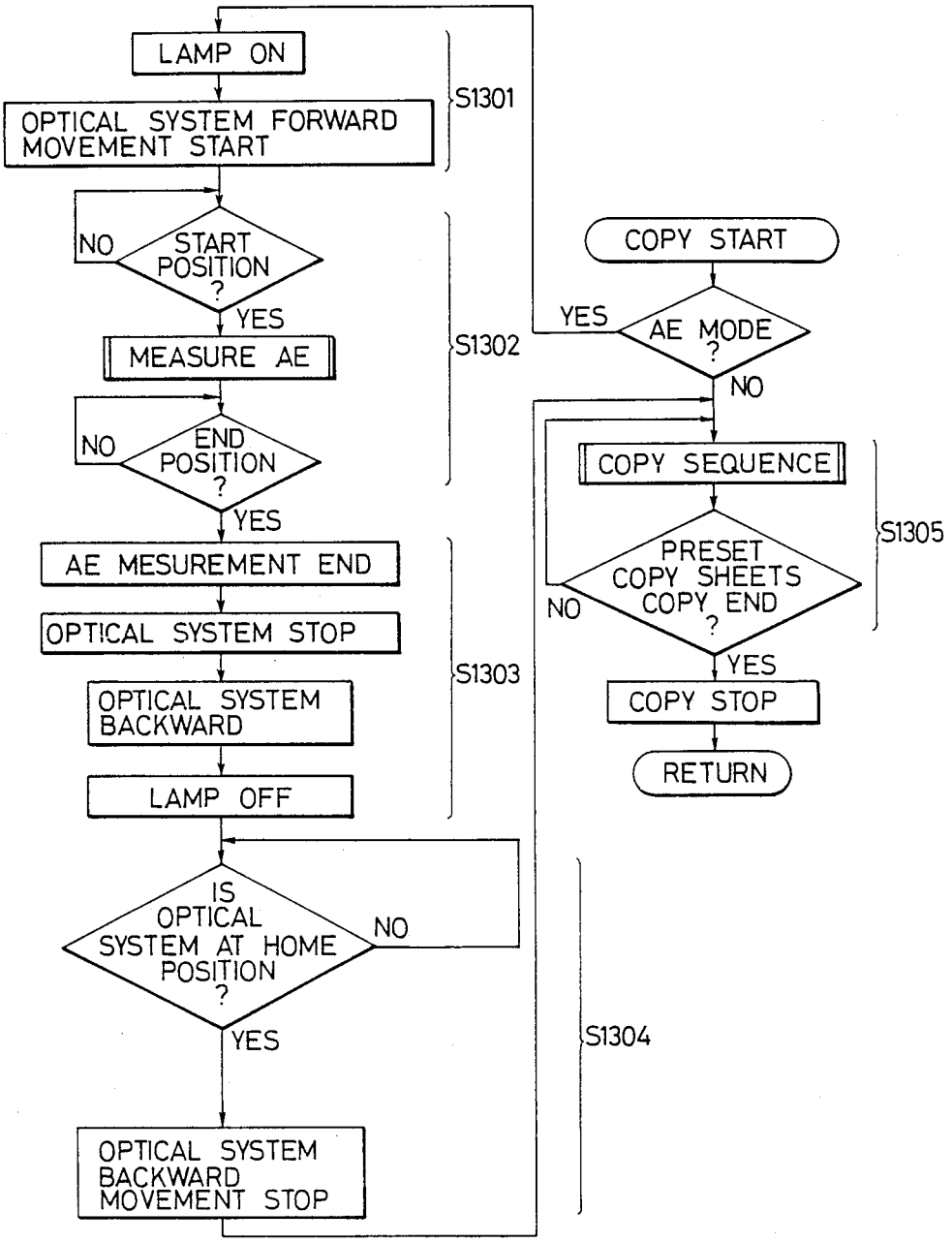
Figure 14:
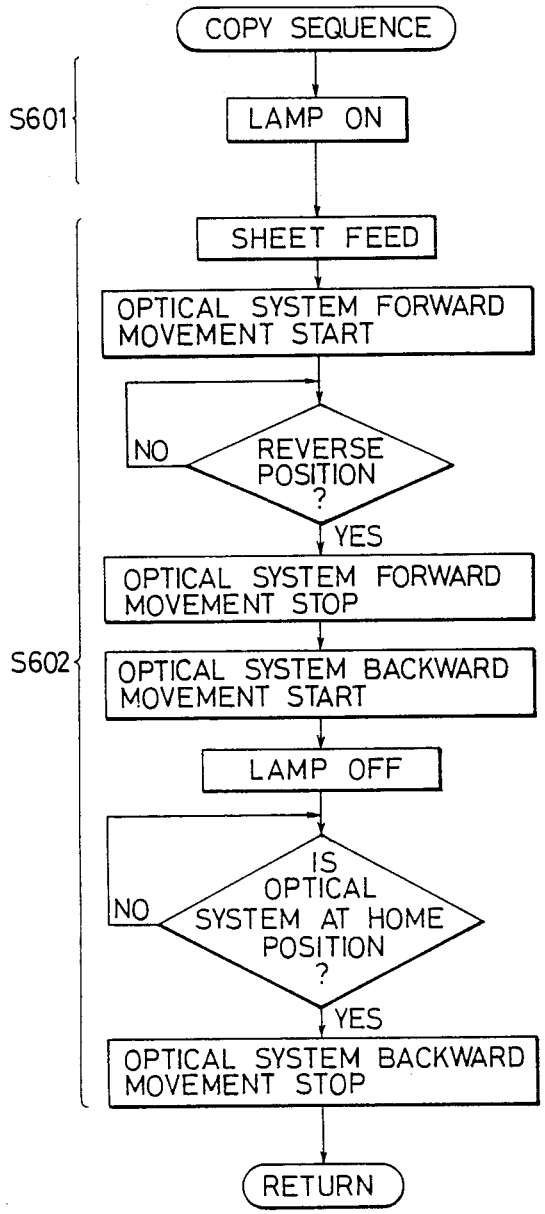

Now reference is made to FIGS. 12 to 14 for explaining the function of the above-described embodiment.

After the start of power supply in FIG. 12, the AE mode is selected in a step S1201. The non-AE mode may be selected until a copying operation is started. More specifically, when the non-AE mode is selected by the switch 127 in a step S1203, a step S1204 sets the non-AE mode. Then, in response to a copy start instruction in a step S1202, a step S1205 starts the copying operation shown in FIG. 5.

FIG. 13 shows the details of said copying operation in step S1205.

At first, a step S1301 identifies whether tee AE mode is selected, and, if affirmative, a pre-scanning for original density measurement is started. On the other hand, in the non-AE mode, the optical system starts the forward motion and the program proceeds to the copying sequence shown in FIG. 14.

When the AE mode is selected, the optical system starts a pre-scanning for determining the exposure (time T1 in FIG. 2). The ensuing function is substantially the same as that explained in relation to FIG. 5.

It is also possible, in addition to the determination of the exposure by a pre-scanning prior to the copying operation, to measure the original image density during the exposure in the copying operation for correcting, if necessary, the exposure determined by said pre-scanning.

Figure 15:
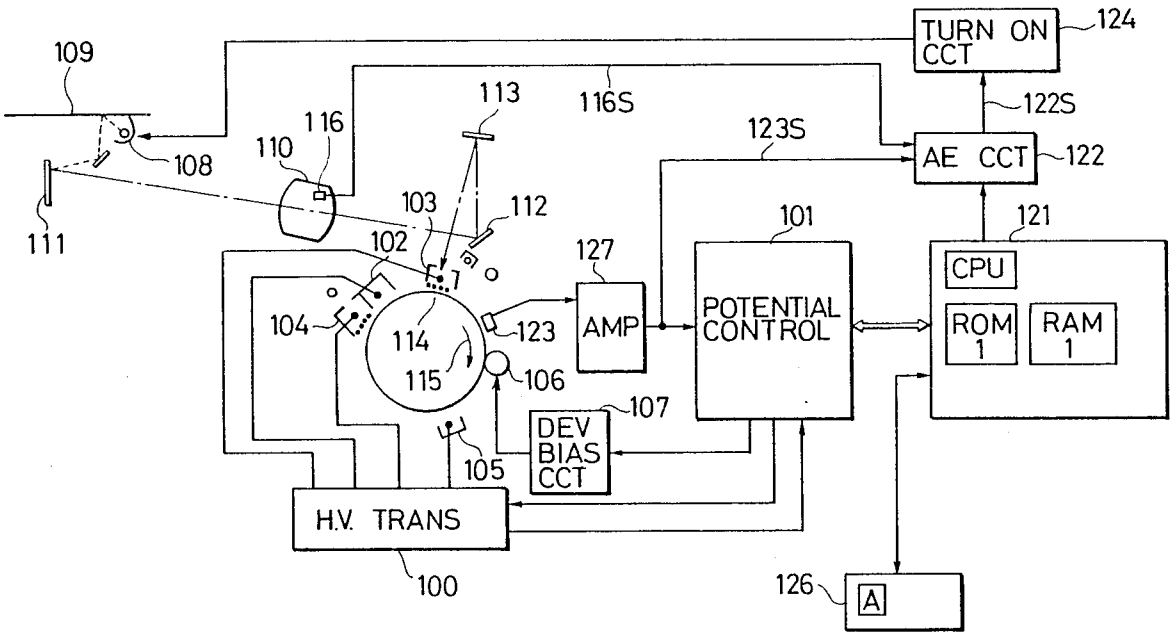
FIG. 15 is a schematic view showing another embodiment of a copier of the present invention.

FIG. 15 is a schematic view of a copier representing this embodiment, wherein same components as those in FIG. 1 are represented by same numbers. The lens 110 is provided with an original sensor or photoreceptor 116 for measuring the original density simultaneously with the original scanning.

Figure 16:
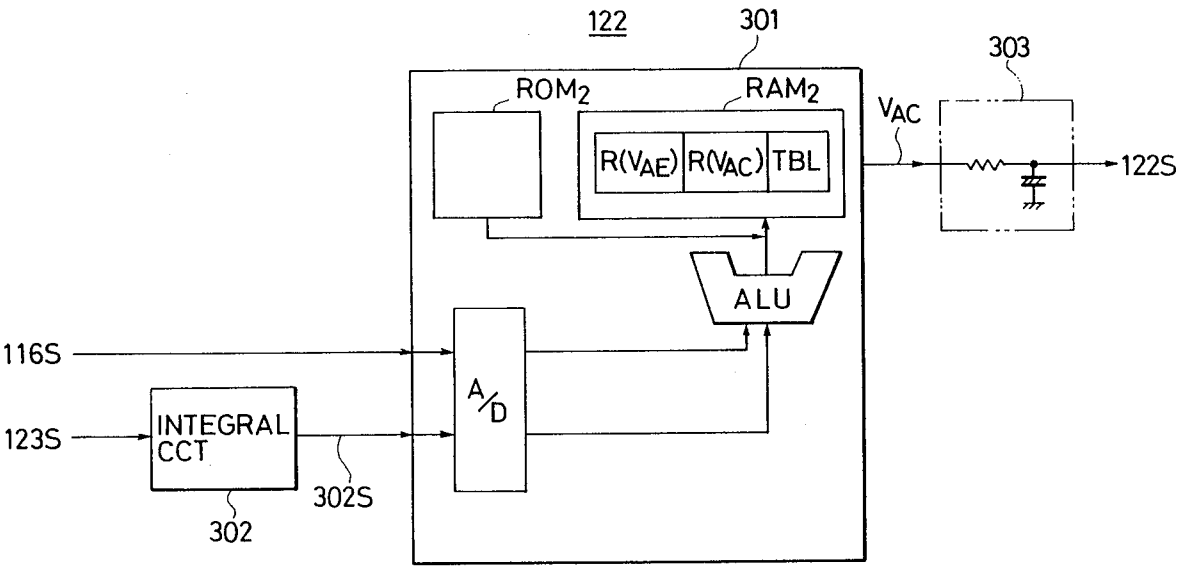
FIG. 16 is a circuit diagram of an exposure control circuit employed in the copier shown in FIG. 15.

FIG. 16 shows the details of the AE circuit 122 shown in FIG. 15, wherein the output signal 116S from the original sensor 116 is supplied to an analog-to-digital converter A/D. Other parts of the circuit are same as those shown in FIG. 3.

Figure 17:
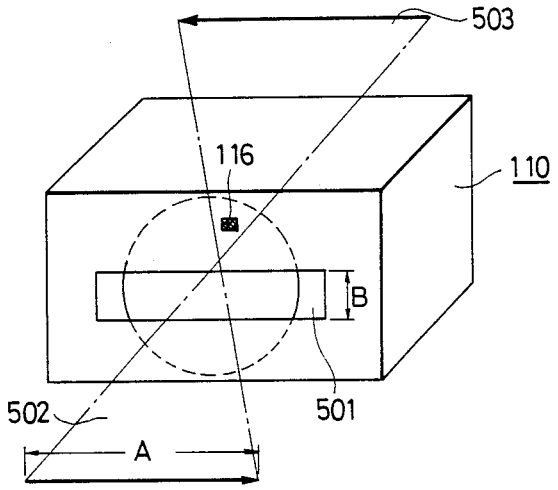
FIG. 17 is a schematic view of a lens employed in the copier shown in FIG. 15.

FIG. 17 shows the internal structure of the lens 110, wherein an arrow of length A represents the main scanning direction of the original. The length of exposure by the optical system in the subsidiary scanning direction is limited to B by a window 501, in order to achieve uniform exposure on the photosensitive member. The original sensor 116 is positioned outside said length B so that no optical effect is given by said sensor 116. Said sensor 116, being positioned not in the original side 502 but in the image side 503 with respect to the lens, is capable of reading the imaged density over a wide range in the main scanning direction.

Figure 18:
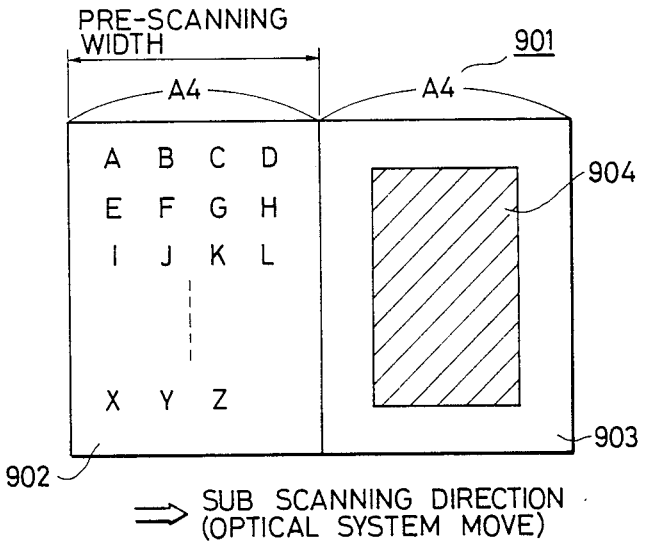
FIGS. 18 and 21 are schematic views showing examples of the original.

In case of copying an A3-sized original as shown in FIG. 18, the aforementioned pre-scanning reads the original image density over an A4-sized area 902 representing a half of the original 901 to determine the original image density. Thus a hatched high-density image area 904, for example a newspaper cut-out, if present i the remaining half 903 of the original 901, is not subjected to the pre-scanning and is not reproduced with an appropriate density if the image formation is conducted with a density determined by the pre-scanning. In order to avoid such inconvenience, a correction is made in the copying sequence in response to the output of the original sensor 116S.

Figure 19:
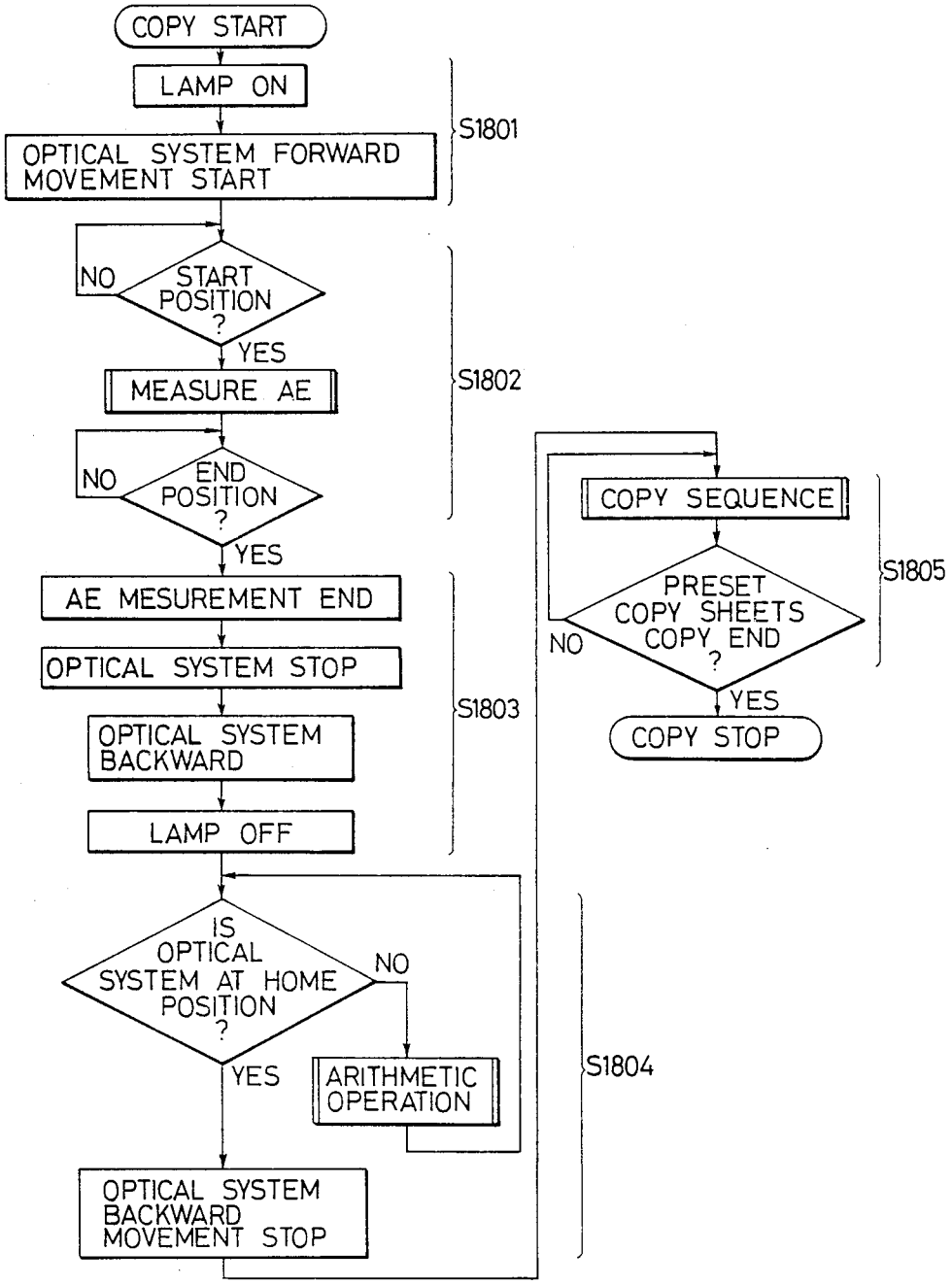
FIGS. 19 and 20 are flow charts showing the function of the copier shown in FIG. 15.

FIG. 19 shows the control sequence of the present embodiment. The function of the present embodiment is substantially same as that shown in FIG. 5 except that the pre-scanning width is previously determined as A4 size.

Figure 20:
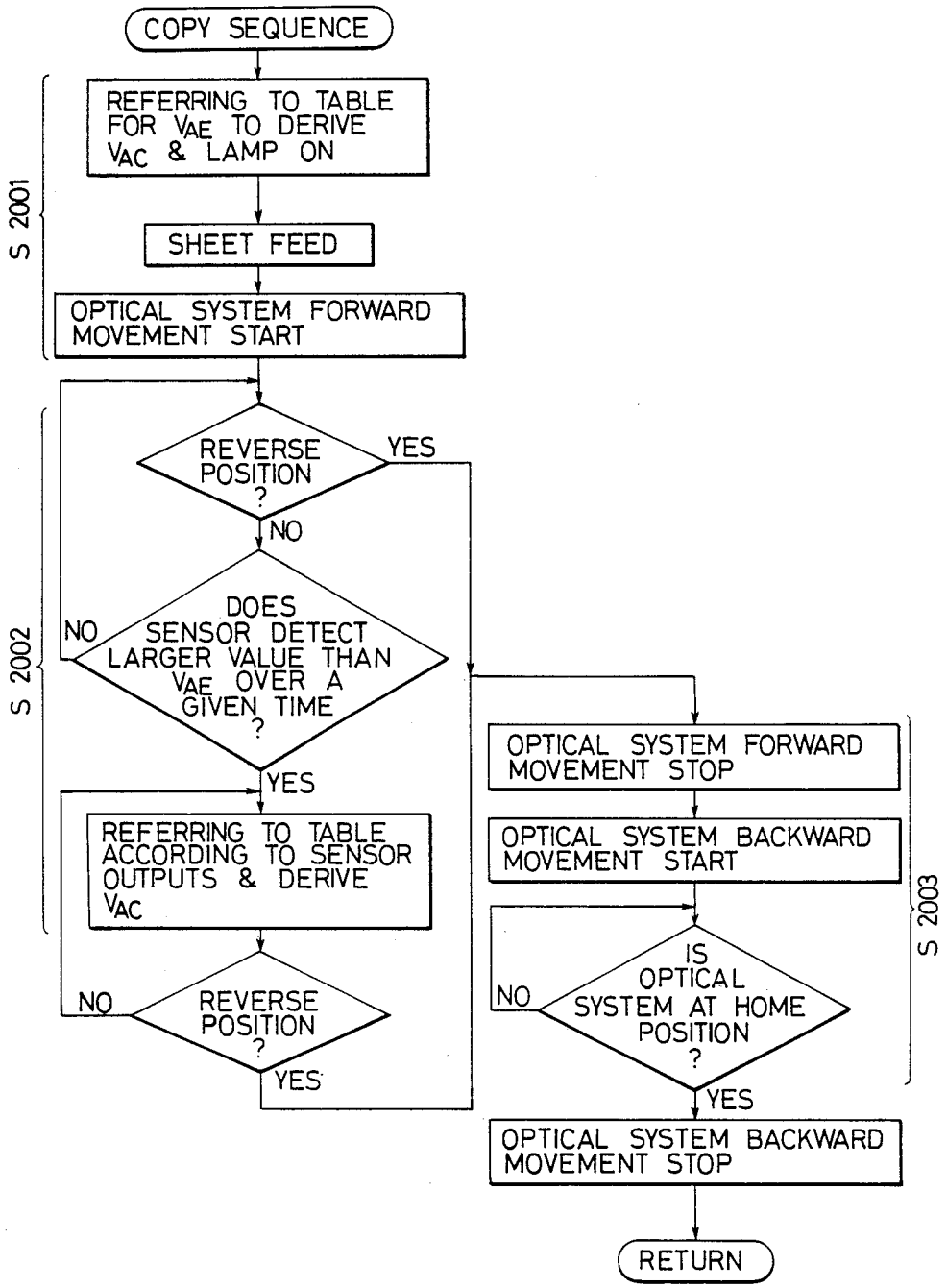

FIG. 20 shows the copying sequence in a step S1805, wherein a step S2001 turns on the illuminating lamp 108 according to a control value $V_{AC}$ determined by the original density obtained in the pre-scanning. Then the sheet feeding is started, and the optical system starts forward motion toward the reversing position. During said motion said step S2002 inspects the output signal from the original sensor 116 through the AE circuit 122. In case of an original as shown in FIG. 18, a value higher than $V_{AE}$ is obtained when the optical system reaches the part 904. In case such state continues over a predetermined period, the $V_{AC}$ table TBL shown in FIG. 7 is referred to by a new value obtained from the sensor 166 instead of the value $V_{AE}$ obtained in the pre-scanning, and a value obtained from said table TBL is released as $V_{AC}$. Such comparison is continuously conducted to regulate the lighting voltage of the illuminating lamp 108.

Figure 21:
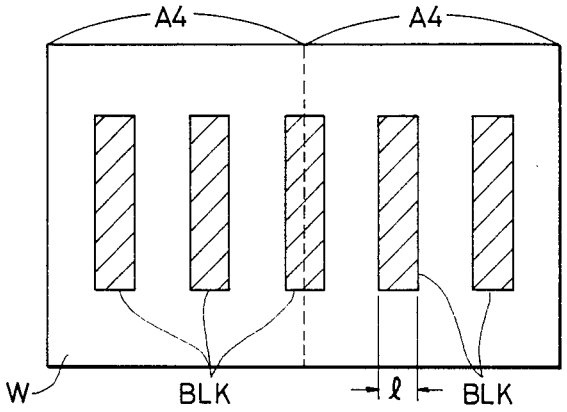

On the other hand, such control avoids the drawback of the successive comparing method explained in the beginning of the text, even in an original as shown in FIG. 21. In such original, in which black areas BLK of a small width periodically appear on a white background, the control under the pre-scanning is maintained in a second mode since the higher value than $V_{AE}$ detected by the original sensor does not continue over the predetermined period because of said small width.

When the optical system reaches the reversing position, a step S2003 terminates the forward motion and starts the backward motion to the home position, thus completing the copying sequence.

As explained in the foregoing, constantly stable image reproduction is ensured in such plural modes of control regardless of the state of the original, as the original image density is measured in a pre-scanning and in successive comparing method and the exposure is controlled by the latter in case the exposure determined by the pre-scanning is identified inadequate.

It is to be noted that the present invention is not limited to the control of exposure explained in the foregoing but is applicable also to the control of the quantity of charge or the developing bias.

In the foregoing embodiments the control values for the illuminating lamp are stored in a random access memory corresponding to different densities of the original, but such values may be stored in a read-only memory for direct access, without the CPU, by the original densities.

What is claimed:

1. An image forming apparatus comprising:

image forming means for forming an image on a recording material, said image forming means being adapted to perform continuously a set number of image forming operations on recording sheets in response to a start command;

means for detecting a condition corresponding to a characteristic of an original prior to the exposure thereof for image formulation; and control means for determining operable conditions of said image forming means for appropriate image formation in accordance with the output of said detecting means;

wherein said control means is adapted, upon reaching a predetermined value in the number of said image formations, after said start command and prior to completion of the set number of said image forming operations, on recording sheets to correct the operable conditions of said image forming means which have been previously determined in accordance with the characteristic of the original.

2. An image forming apparatus according to claim 1, wherein said control means is adapted, upon reaching said predetermined value, to cause said detecting means to again detect the state of said original and to correct said operable conditions in accordance with the result of said detection.

3. An image forming apparatus according to claim 2, wherein said detection of said condition by said detecting means is not conducted under a certain condition even when said predetermined value in the number of sheets of image formation is reached.

4. An image forming apparatus according to claim 3, wherein said certain condition is a condition that the remaining number of times of image formation is less than said predetermined value.

5. An image forming apparatus according to claim 1, wherein said control means is adapted, upon reaching said predetermined value in the number of sheets of image formation, to correct said operable conditions by means of modifying the output of said detecting means.

6. An image forming apparatus according to claim 1, wherein said image forming means comprises exposure means for exposing said original, and said control means is adapted to control the operable conditions of said exposure means.

7. An image forming apparatus comprising:

image forming means for forming an image on a recording material, said image forming means including a photosensitive member on which an electrostatic latent image is formed and scanning means for exposure-scanning an original;

first detecting means for detecting the potential of the latent image formed on said photosensitive member corresponding to the original image prior to the exposure thereof for image formation;

second detecting means for receiving the light reflected from the original during the exposure thereof for image formation; and control means for properly controlling the operational condition of said image forging means, wherein said control means is capable of properly controlling said operational condition in plural modes, and is adapted to control properly said operational condition in a mode selected from said plural modes in accordance with the detected result of said first and second detecting means.

8. An image forming apparatus according to claim 7, wherein said second detecting means comprises photoreceptor means for receiving the light reflected from the original.

9. An image forming apparatus comprising:

image forming means for forming an image on a recording material;

first detecting means for detecting a condition corresponding to a characteristic of an original prior to the exposure thereof for image formation;

second detecting means of detecting a condition corresponding to a characteristic of said original during the exposure thereof for image formation; and control means for controlling said image forming means in accordance with the results of detection of said first and second detecting means, wherein said control means comprises comparator means for comparing the results of detection of said first and second detecting means, and is adapted to control said image forming means in accordance with the output of said comparator means, and wherein said control means is adapted to determine operable conditions of said image forming means in response to the result of detection of said first detecting means, and, upon discrimination by said comparator means during image formation that said operable conditions are inadequate, to determine operable conditions of said image forming means in response to the result of detection by said second detecting means.

10. An image forming apparatus according to claim 9, wherein said comparator means is adapted to identify that said operable conditions determined in response to the result of detection by said first detecting means are inadequate, when the result of detection by said first detecting means is different from that by said second detecting means for a determined period.

11. An image forming apparatus according to claims 9 or 10, wherein said image forming means comprises a photosensitive member, and said first detecting means comprises potential detecting means for detecting the potential of a latent image formed on said photosensitive member corresponding to the original image.

12. An image forming apparatus according to claims 9 or 10, wherein said second detecting means comprises photoreceptor means for receiving the light reflected from the original.

13. An image forming apparatus comprising:

manual instructing means for generating a start command for starting an image formation;

image forming means for forming an image on a recording material by means of scanning an original, said image forming means being adapted to perform a set number of image forming operations on recording sheets in response to the start command from said instructing means;

detecting means for detecting a condition corresponding to a characteristic of the original; and control means for controlling said detecting means so as to detect said condition upon scanning the original after generation of the start command, and then to detect again said condition upon scanning the original at a predetermined time after the earlier detection without a start command from said instructing means.

14. An image forming apparatus according to claim 13, wherein said control means is adapted to correct the operable conditions of said image forming means in response to the output of said detecting means.

15. An image forming apparatus comprising:

image forming means for forming an image on a recording material;

first detecting means for detecting a condition corresponding to a characteristic of an original prior to the exposure thereof for image formation;

second detecting means for detecting the state of a condition corresponding to a characteristic of said original during the exposure thereof for image formation;

control means for controlling an operation condition of said image forming means in a first mode or a second mode; and selecting means for selecting either one of said first mode or said second mode in accordance with outputs of said first and second detecting means, wherein said selecting means is operable to switch the control mode from the first mode to the second mode, to control the operation condition of said image forming means, in the event that there is found a predetermined relation between data associated with the output of said first detecting means and data associated with the output of said second detecting means.

16. An apparatus according to claim 15, wherein the operation condition of said image forming means is controlled in said first mode in accordance with the output of said first detecting means.

17. An apparatus according to claim 15, wherein said second detecting means detects the condition corresponding to a characteristic of the original during image formation.

* * * * *

UNITED STATES PATENT AND TRADEMARK OFFICE

CERTIFICATE OF CORRECTION

PATENT NO. : 4,831,415

DATED : May 16, 1989

INVENTOR(S) : YUKIO KASUYA

It is certified that error appears in the above-identified patent and that said Letters Patent is hereby corrected as shown below:

COLUMN 1

Line 15, "imaged" should read --image--.
Line 52, "is" should be deleted.

COLUMN 2

Line 5, "time" should read --times--.
Line 15, "$" should be deleted.
Line 29, "output" should read --outputs--.

COLUMN 4

Line 41, "of" (second occurrence) should read --of the--
.

COLUMN 6

Line 12, "tee" should read --the--.
Line 24, "same" should read --the same--.
Line 45, "tee" should read --the--.

COLUMN 7

Line 66, "tee" should read --the--.

COLUMN 8

Line 42, "i" should read --in--.

UNITED STATES PATENT AND TRADEMARK OFFICE

CERTIFICATE OF CORRECTION

PATENT NO. : 4,831,415

DATED : May 16, 1989

INVENTOR(S) : YUKIO KASUYA

It is certified that error appears in the above-identified patent and that said Letters Patent is hereby corrected as shown below:

COLUMN 9

Line 9, "width" should read --width $l$--.
Line 45, "image formulation;" should read --image formation;--.

COLUMN 10

Line 29, "image forging means," should read --image forming means,--.
Line 46, "of" should read --for--.

Signed and Sealed this

Twenty-eighth Day of August, 1990

*Attest:*

HARRY F. MANBECK, JR.

*Attesting Officer*

*Commissioner of Patents and Trademarks*